US005752123A

United States Patent [19]

Cheng

[11] Patent Number: 5,752,123

[45] Date of Patent: May 12, 1998

[54] AUTOMATIC X RAY DEVELOPING DEVICE

[76] Inventor: Jeng-Kuo Cheng, 9F, No. 163, Ming Sheng 2nd Road, Kao Shiong, Taiwan

[21] Appl. No.: 755,897

[22] Filed: Dec. 2, 1996

[51] Int. Cl.[6] ..... G03D 3/08

[52] U.S. Cl. ..... 396/621; 396/636

[58] Field of Search ..... 396/590, 589, 396/591, 592, 612, 617, 621, 622, 636, 647, 651, 652, 645

[56] References Cited

U.S. PATENT DOCUMENTS

| | | | |
|---|---|---|---|
| 3,683,781 | 8/1972 | Allen | 396/636 |
| 4,011,573 | 3/1977 | Braico | 396/621 |
| 4,410,257 | 10/1983 | Thebault | 396/622 |
| 4,531,821 | 7/1985 | Mears | 396/621 |
| 4,655,575 | 4/1987 | Murakami | 396/621 |
| 5,166,720 | 11/1992 | Tanaka | 396/621 |

*Primary Examiner*—D. Rutledge

*Attorney, Agent, or Firm*—Peterson, Wicks, Nemer & Kamrath, P.A.

[57] ABSTRACT

An automatic X ray developing device comprises a base platform, four support legs disposed beneath four corners of the base platform respectively, a rotating disk and a motor disposed beneath the base platform, a plurality of rollers disposed on the base platform, a cylindrical container disposed on the base platform, a clamp seat disposed on the base platform, and a U-shaped seat disposed on the rollers. Three vessels are disposed in the cylindrical container. The cylindrical container, the base platform, and the rotating disk are fastened together. The motor has a shaft. A driving wheel encloses the shaft of the motor. The rotating disk abuts the driving wheel. A clamp holder has an extended rod, a hooked end connected to the extended rod, and a clamp hanging on the extended rod. The clamp clamps an X ray film. The hooked end is disposed on the clamp seat.

17 Claims, 6 Drawing Sheets

AUTOMATIC X RAY DEVELOPING DEVICE

BACKGROUND OF THE INVENTION

The invention relates to an X ray developing device. More particularly, the invention relates to an automatic X ray developing device which can be used conveniently.

Referring to FIG. 1, a conventional X ray developing. device has an opaque box 10, a top cover 11 disposed on a top portion of the opaque box 10, two openings 12 formed on the opaque box 10, two steel loops 13 inserted in the openings 12 respectively, two sleeves 14 confined by the steel loops 13 respectively, each sleeve 14 having an elastic ring 15 at its distal end, and first, second and third containers A, B and C disposed in the opaque box 10. A bulb casing 18 is disposed in the opaque box 10, and a switch 19 is disposed on the opaque box 10. A socket 16 and a bulb 17 are disposed in the bulb casing 18. The socket 16 receives the bulb 17. The first container A contains a developing agent. The second container B contains a fixing agent. The third container C contains water. The user holds a clamping device 20 which clamps an X ray film in the opaque box 10. The X ray film is dipped into the first, second and third containers A, B and C in order. Since the opaque box 10 is very narrow, it is not convenient for the user to operate the clamping device 20 manually.

SUMMARY OF THE INVENTION

An object of the invention is to provide an X ray developing device which can be used conveniently.

Accordingly, an automatic X ray developing device comprises a base platform, four support legs disposed beneath four corners of the base platform respectively, a rotating disk and a motor disposed beneath the base platform, a plurality of spaced rollers disposed on the base platform, a cylindrical container disposed on the spaced rollers, a clamp seat disposed on the base platform, and a U-shaped seat disposed on the base platform. First, second and third vessels are disposed in the cylindrical container. The first vessel contains a developing agent. The second vessel contains a fixing agent. The third vessel contains water. Three inner plates are disposed in a bottom of the cylindrical container to separate the first, second and third vessels. A block is disposed on an outer periphery of the cylindrical container. At least two outer plates are disposed on the outer periphery of the cylindrical container. A plurality of crenatures are formed on an upper rim of the cylindrical container. A lateral plate is disposed on the clamp seat. The lateral plate has a flat upper portion and a curved lateral portion. A round plate and a triangular plate are disposed on the clamp seat. A gap is formed between the round plate and the triangular plate. A cover plate covers the round plate. A stopping plate is disposed on the clamp seat. A button switch, a microswitch and a lever are disposed on the U-shaped seat. The microswitch controls an operation of the lever. A threaded hole is formed on the base platforms The cylindrical container, the base platform, and the rotating disk are fastened together. The motor has a shaft. A driving wheel encloses the shaft of the motor. The rotating disk abuts the driving wheel. A clamp holder has an extended rod, a hooked end connected to the extended rod, and a clamp hanging on the extended rod. The hooked end hooks the round plate. The clamp is placed in the cylindrical container.

DETAILED DESCRIPTION OF THE INVENTION

Figure 1:
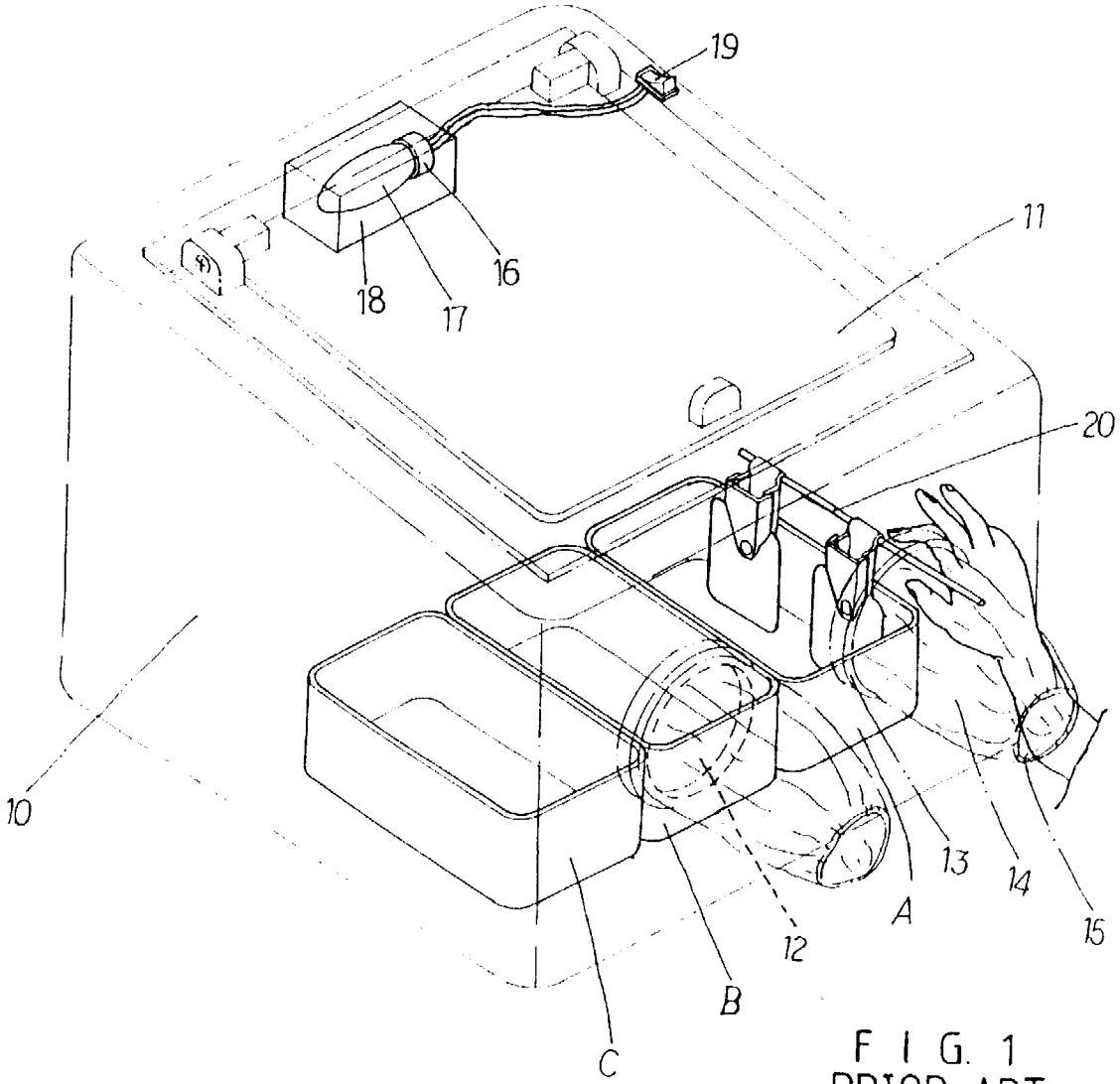
FIG. 1 PRIOR ART
FIG. 1 is a perspective view of an X ray developing device of the prior art.
Figure 2:
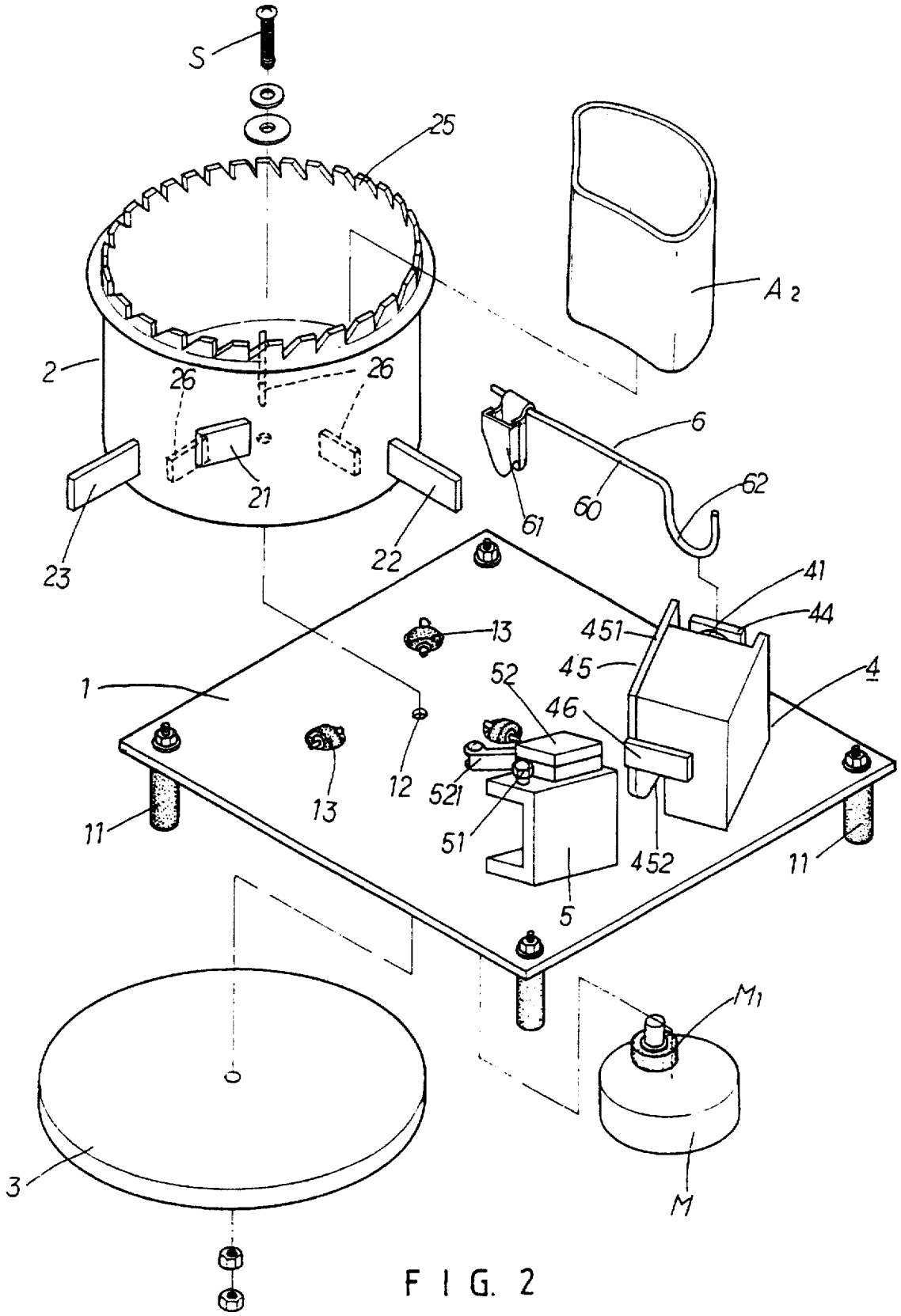
FIG. 2 is a perspective exploded view of an automatic X ray developing device of a preferred embodiment in accordance with the invention.
Figure 3:
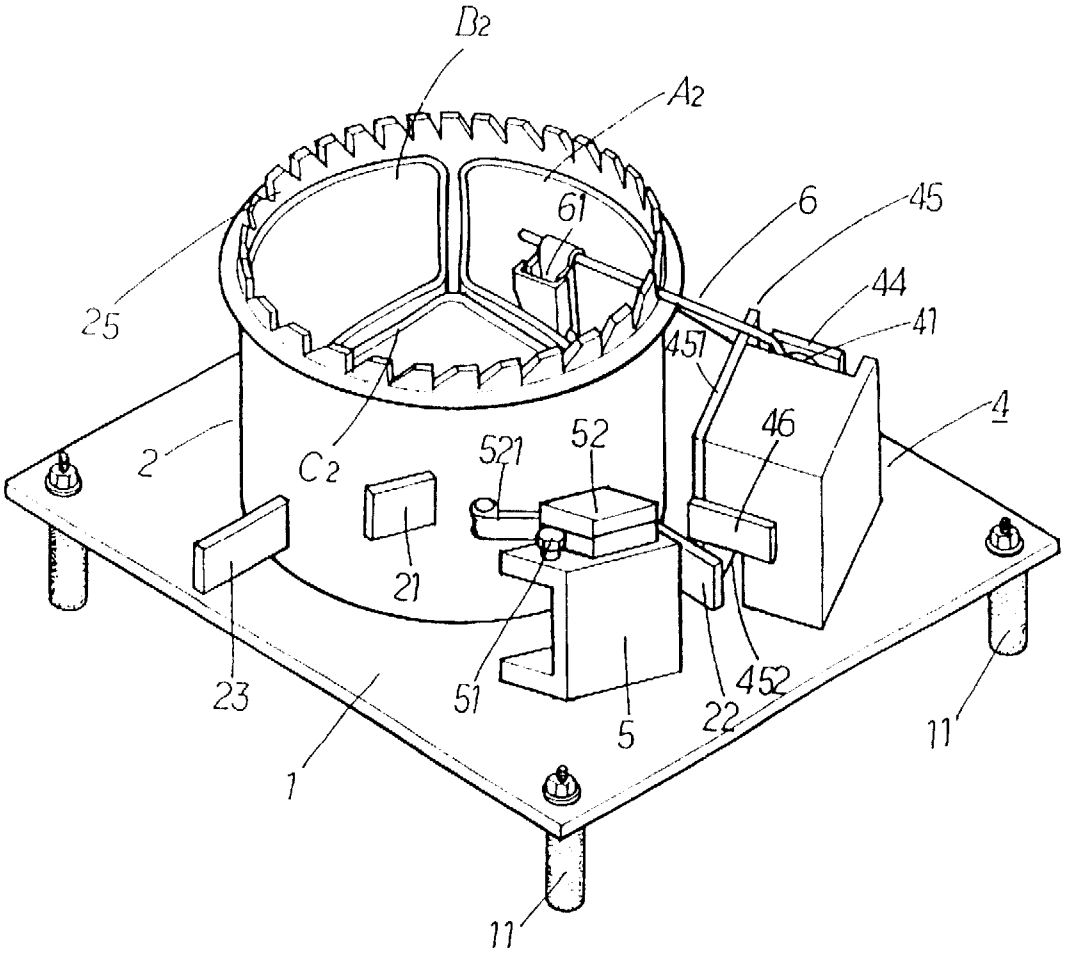
FIG. 3 is a perspective assembly view of FIG. 2.
Figure 4:
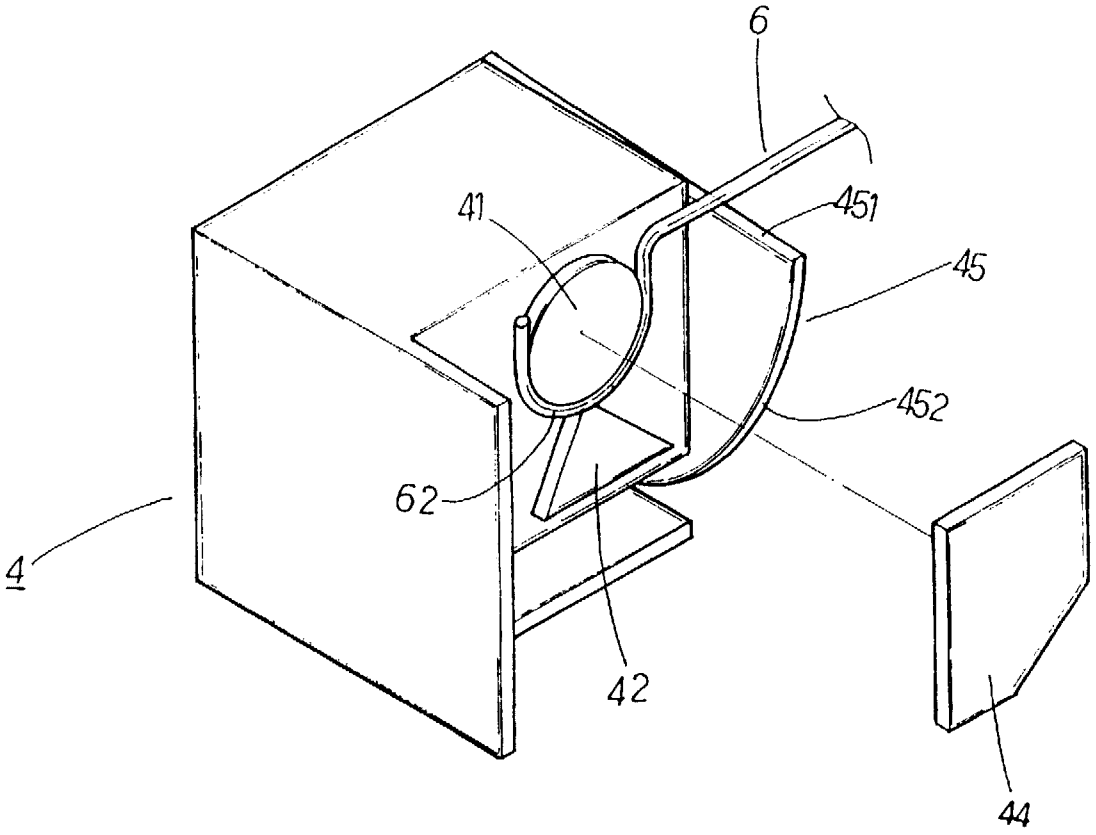
FIG. 4 is a perspective(exploded view of a clamp seat.
Figure 5:
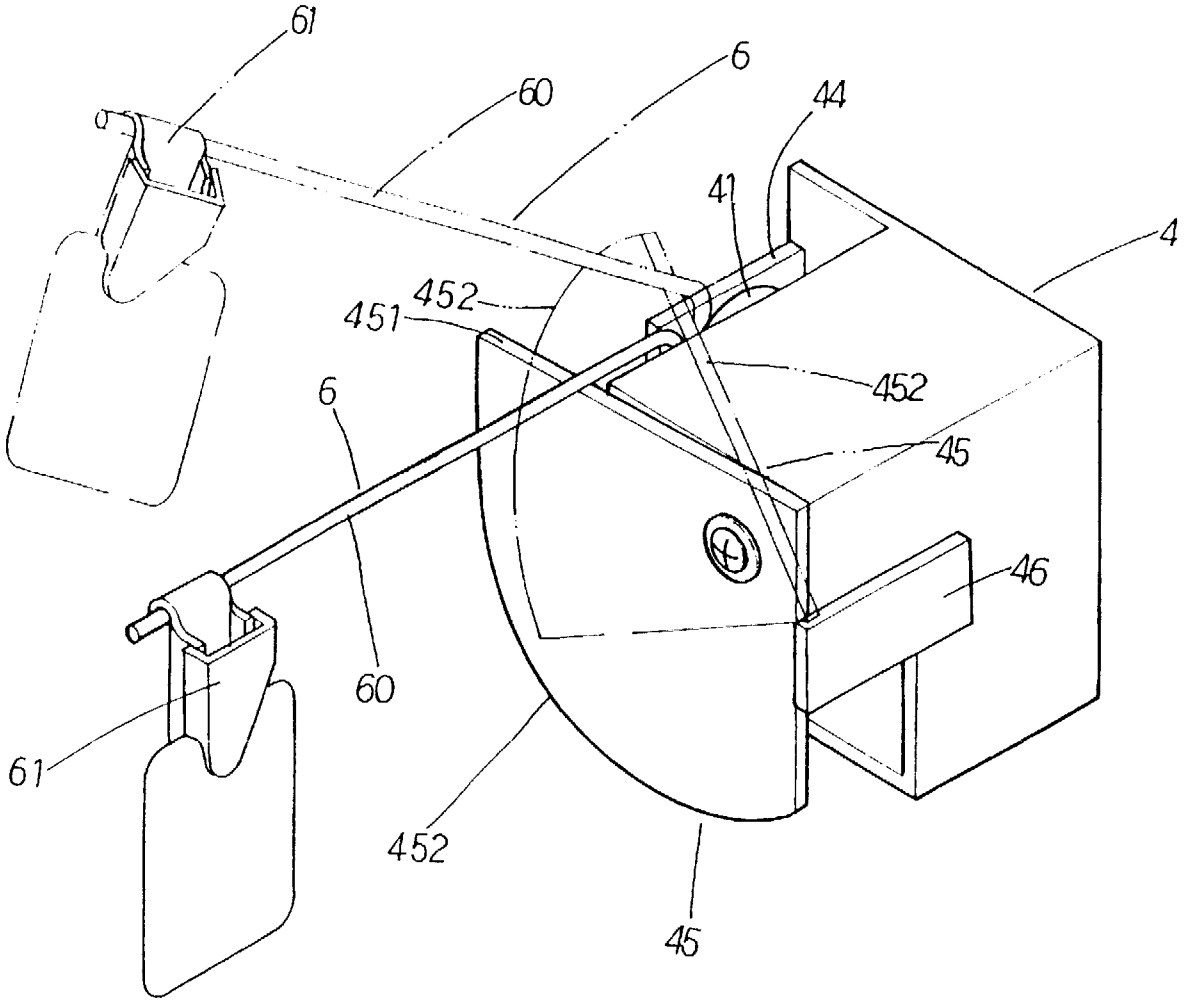
FIG. 5 is a schematic view illustrating an operation of the clamp seat.
Figure 6:
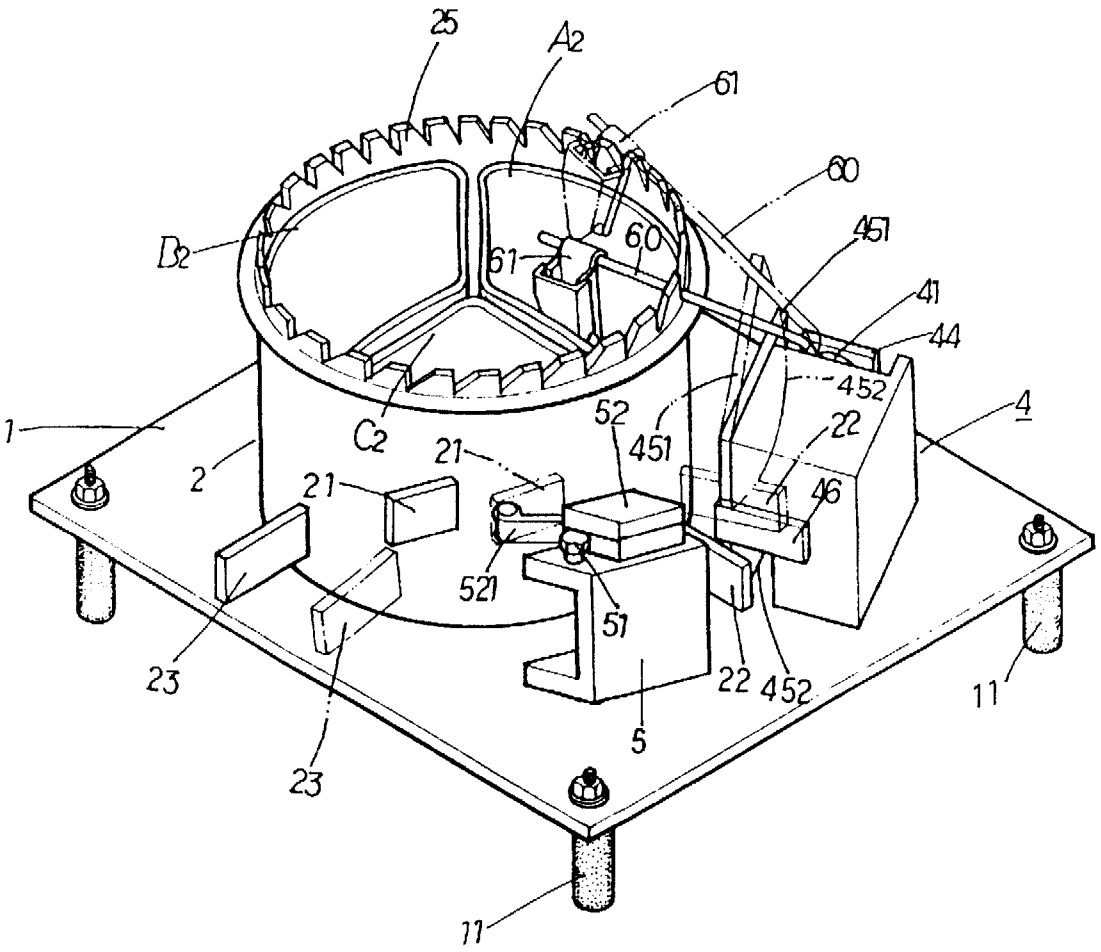
FIG. 6 is a schematic view illustrating an operation of the automatic X ray developing device.

Referring to FIGS. 2 to 6, an automatic X ray developing device comprises a base platform 1, four support legs 11 disposed beneath four corners of the base platform 1 respectively, a rotating disk 3 and a motor M disposed beneath the base platform 1, a plurality of spaced rollers 13 disposed on the base platform 1, a cylindrical container 2 disposed on the spaced rollers 13, a clamp seat 4 disposed on the base platform 1, and a U-shaped seat 5 disposed on the base platform 1. First, second and third vessels A2, B2 and C2 are disposed in the cylindrical container 2. The first vessel A2 contains a developing agent. The second vessel B2 contains a fixing agent. The third vessel C2 contains water. Three inner plates 26 are disposed in a bottom of the cylindrical container 2 to separate the vessels A2, B2 and C2. A block 21 is disposed on an outer periphery of the cylindrical container 2. At least first and second outer plates 22 and 23 are disposed on the outer periphery of the cylindrical container 2. A plurality of crenatures 25 are formed on an upper rim of the cylindrical container 2. A lateral plate 45 is disposed on the clamp seat 4 pivotally. The lateral plate 45 has a flat upper portion 451 and a curved lateral portion 452. A round plate 41 and a triangular plate 42 are disposed on the clamp seat 4. A gap is formed between the round plate 41 and the triangular plate 42. A cover plate 44 covers the round plate 41. A stopping plate 46 is disposed on the clamp seat 4. A button switch 51, a microswitch 52 and a lever 521 are disposed on the U-shaped seat 5. The microswitch 52 controls an operation of the lever 521. A threaded hole 12 is formed on the base platform 1. The cylindrical container 2, the base platform 1, and the rotating disk 3 are fastened by a bolt S via the threaded hole 12. The motor M has a shaft. A driving wheel Ml encloses the shaft of the motor M. The rotating disk 3 abuts the driving wheel M1. A clamp holder 6 has an extended rod 60, a hooked end 62 connected to the extended rod 60, and a clamp 61 hanging on the extended rod 60. The hooked end 62 hooks the round plate 41. The clamp 61 clamps an X ray film. The clamp 61 is placed in the cylindrical container 2 so that the X ray film can be dipped into one of the first, second and third vessels A2, B2 and C2. The lever 521 touches the block 21. The first outer plate 22 supports a bottom of the lateral plate 45.

Initially, first outer plate 22 is engaged with and supports the lateral plate 45 in its pivoted position to hold clamp holder 6 spaced from the cylindrical container 2 and the lever 521 touches the block 21. When the button switch 51 is turned on, the motor M is actuated to rotate the driving wheel Ml. The driving wheel M1 will rotate the rotating disk 3. The cylindrical container 2 will be rotated also. When the cylindrical container 2 is rotated, the lever 521 will not touch the block 21. The first outer plate 22 will not support the lateral plate 45. Thus, the lateral plate 45 pivots relative to the clamp seat 4 to engage the stopping plate 46. The clamp holder 6 engaging the flat upper portion 451 then pivots relative to the clamp seat 4 with the extended rod 60 engaging the crenatures 25 on the upper rim of the cylindrical container 2 so that the X ray film in the clamp 61 is dipped in the vessels A2, B2 and C2. Engagement of the outer plates 22 and 23 with the lateral plate 45 causes the clamp holder 6 to pivot to raise the clamp 61 spaced from the cylindrical container 2 for introduction into the next vessel A2, B2, or C2. Therefor, the X ray clamped in the clamp 61 is dipped in the first, second and third vessels A2, B2 and C2 in order. When the lever 521 touches the block 21 again, the microswitch 52 will control the motor M to stop rotation of the cylindrical container 2.

The invention is not limited to the above embodiment but various modification thereof may be made. Further, various changes in form and detail may be made without departing from the scope of the invention.

I claim:

1. An automatic X ray developing device comprising, in combination: a base platform; a cylindrical container rotatably disposed upon the base platform; a first vessel adapted to contain a developing agent; a second vessel adapted to contain a fixing agent; a third vessel adapted to contain water, with the first, second and third vessels disposed in the cylindrical container; a clamp seat disposed on the base platform; a clamp holder having an extended rod and a clamp hanging on the extended rod, with the extended rod being pivotal relative to the clamp seat, with the clamp adapted to hold the X ray; and means for pivoting the clamp holder relative to the clamp seat in response to the rotation of the cylindrical container to move the clamp so that the X ray held in the clamp is dipped into one of the first, second and third vessels.

2. An automatic X ray developing device as claimed in claim 1 wherein the pivoting means comprises means for pivoting the clamp holder between a first position where the clamp is placed in the cylindrical container and a second position where the clamp is spaced from the cylindrical container.

3. An automatic X ray developing device as claimed in claim 2 wherein the pivoting means comprises, in combination: at least first and second outer plates disposed on the cylindrical container; a lateral plate pivotally disposed on the clamp seat, with the extended rod supported on the lateral plate, with the outer plates engaging the lateral plate as the result of the rotation of the cylindrical container and pivoting the lateral plate and thereby pivoting the clamp holder between the first and second positions.

4. An automatic X ray developing device as claimed in claim 3, wherein the lateral plate has a flat upper portion and a curved lateral portion, with the extended rod being supported on the flat upper portion and with the curved lateral portion engaging the first and second outer plates during rotation of the cylindrical container.

5. An automatic X ray developing device as. claimed in claim 3 wherein the clamp seat includes a round plate, with the clamp holder including a hooked end connected to the extended rod and hooked on the round plate for pivotally mounting the clamp holder relative to the clamp seat.

6. An automatic X ray developing device as claimed in claim 5 wherein the clamp seat further includes a triangular plate, with a gap formed between the round plate and the triangular plate for receiving the hooked end.

7. An automatic X ray developing device as claimed in claim 3 wherein the cylindrical container includes an upper rim, with the extended rod engaging the upper rim; and wherein the pivoting means further comprises, in combination: a plurality of crenatures formed on the upper rim for pivoting the clamp holder relative to the clamp seat in response to the rotation of the cylindrical container.

8. An automatic X ray developing device as claimed in claim 7 further comprising, in combination: a motor disposed on the base platform; and a disk rotatable relative to the base platform, with the cylindrical container being fastened to the disk, with the motor having a shaft including a driving wheel abutting with the disk for rotating the disk and the cylindrical container fastened thereto.

9. An automatic X ray developing device as claimed in claim 8 further comprising, in combination: a block disposed on the cylindrical container; a lever disposed on the base portion for engaging the block; and a microswitch controlled by the lever, with the microswitch controlling the motor to stop rotation of the cylindrical container when the lever engages the block due to the rotation of the cylindrical container.

10. An automatic X ray developing device as claimed in claim 6, wherein a cover plate covers the round plate.

11. An automatic X ray developing device as claimed in claim 10 further comprising, in combination: a stopping plate disposed on the clamp seat for holding the lateral plate relative to the clamp seat when not engaged by the outer plates.

12. An automatic X ray developing device as claimed in claim 1 wherein the cylindrical container includes an upper rim, with the extended rod engaging the upper rim; and wherein the pivoting means comprises, in combination: a plurality of crenatures formed on the upper rim for pivoting the clamp holder relative to the clamp seat in response to the rotation of the cylindrical container.

13. An automatic X ray developing device as claimed in claim 12 further comprising, in combination: a motor disposed on the base platform; and a disk rotatable relative to the base platform, with the cylindrical container being fastened to the disk, with the motor having a shaft including a driving wheel abutting with the disk for rotating the disk and the cylindrical container fastened thereto.

14. An automatic X ray developing device as claimed in claim 13 further comprising, in combination: a block disposed on the cylindrical container; a lever disposed on the base portion for engaging the block; and a microswitch controlled by the lever, with the microswitch controlling the motor to stop rotation of the cylindrical container when the lever engages the block due to the rotation of the cylindrical container.

15. An automatic X ray developing device as claimed in claim 1 further comprising, in combination: a motor disposed on the base platform; and a disk rotatable relative to the base platform, with the cylindrical container being fastened to the disk, with the motor having a shaft including a driving wheel abutting with the disk for rotating the disk and the cylindrical container fastened thereto.

16. An automatic X ray developing device as claimed in claim 15 further comprising, in combination: a block disposed on the cylindrical container; a lever disposed on the base portion for engaging the block; and a microswitch controlled by the lever, with the microswitch controlling the motor to stop rotation of the cylindrical container when the lever engages the block due to the rotation of the cylindrical container.

17. An automatic X ray developing device as claimed in claim 1 further comprising, in combination: a block disposed on the cylindrical container; a lever disposed on the base portion for engaging the block; and a microswitch controlled by the lever, with the microswitch controlling the rotation of the cylindrical container to stop rotation of the cylindrical container when the lever engages the block due to the rotation of the cylindrical container.

* * * * *